United States Patent [19]

Frankenberg

[11] Patent Number: 4,458,241

[45] Date of Patent: Jul. 3, 1984

[54] DEVICE FOR PROTECTING WORKS OF ART

[75] Inventor: Henry E. Frankenberg, Sarasota, Fla.

[73] Assignee: Psi Limited, Olympia Fields, Ill.

[21] Appl. No.: 290,363

[22] Filed: Sep. 1, 1981

[51] Int. Cl.[3] ..... G08B 13/14

[52] U.S. Cl. ..... 340/571; 200/61.51; 200/61.52

[58] Field of Search ..... 340/571, 568; 200/61.48, 61.49, 61.51, 61.52

[56] References Cited

U.S. PATENT DOCUMENTS

| | | | |
|---|---|---|---|
| 1,068,928 | 7/1913 | Pucel | 340/571 X |
| 2,448,181 | 8/1948 | Holm | 340/571 X |
| 3,389,236 | 6/1968 | Guthart | 200/61.48 |
| 3,674,950 | 7/1972 | Scoville | 200/61.48 |
| 3,760,402 | 9/1973 | Magerle et al. | 340/666 X |
| 4,039,789 | 8/1977 | Hase | 200/61.52 |
| 4,101,876 | 7/1978 | Lurkis et al. | 340/568 X |

FOREIGN PATENT DOCUMENTS

| | | | |
|---|---|---|---|
| 1121507 | 1/1962 | Fed. Rep. of Germany | 340/568 |
| 1289866 | 2/1962 | France | 340/568 |
| 2397689 | 3/1979 | France | 340/571 |
| 849962 | 9/1960 | United Kingdom | 340/571 |

*Primary Examiner*—Glen R. Swann, III

*Attorney, Agent, or Firm*—John J. Kowalik

[57] ABSTRACT

An anti-theft device having a pair of contact elements mountable on a picture frame, one of the elements being pendulously swingable with reference to the other so as to contact or break contact with the other element when the picture is disturbed, and thereby actuating a circuit which sets off an alarm.

9 Claims, 4 Drawing Figures

DEVICE FOR PROTECTING WORKS OF ART

BACKGROUND OF THE INVENTION

Art theft and vandalism have increased in recent years and sophisticated equipment has been developed to thwart such activities. There are heat sensitive devices, various electric eye systems, sonic devices etc. most of which are costly and difficult to install and maintain. Furthermore, such devices are usually single purpose in that they are useful at times when the area, such as a museum, is closed to the public. Other devices require extensive wiring which must be done unobtrusively so as not to detract from the art presentation.

SUMMARY OF THE INVENTION

This invention is directed to an anti-theft device which is also useful to inhibit wanton as well as negligent vandalism.

The invention comprehends the provision of a separate, inexpensive, effective device for each item of art work such as a painting and which may be mounted on the painting easily and is sensitive to event the slightest movement of the art piece.

The invention contemplates the provision of a novel pendulum switch which is adapted to be mounted on the framework supporting the painting and which cooperates with an alarm which sounds when the switch is closed attendant to tilting of the painting upon the removal of the painting from its mounting location.

A further object is to provide a novel device which includes a plurality of contact points which are adjustable toward the back side of the painting canvass such that when the front side is fingered by the patron, the deflection of the canvass will be translated to the contact point in the immediate vicinity thereby swinging the switching element to contact or out of contact position and actuating the alarm circuit.

These and other objects and advantages inherent and encompassed by the invention will become more apparent from the specification and the drawings, wherein.

DESCRIPTION OF THE INVENION

Figure 1:
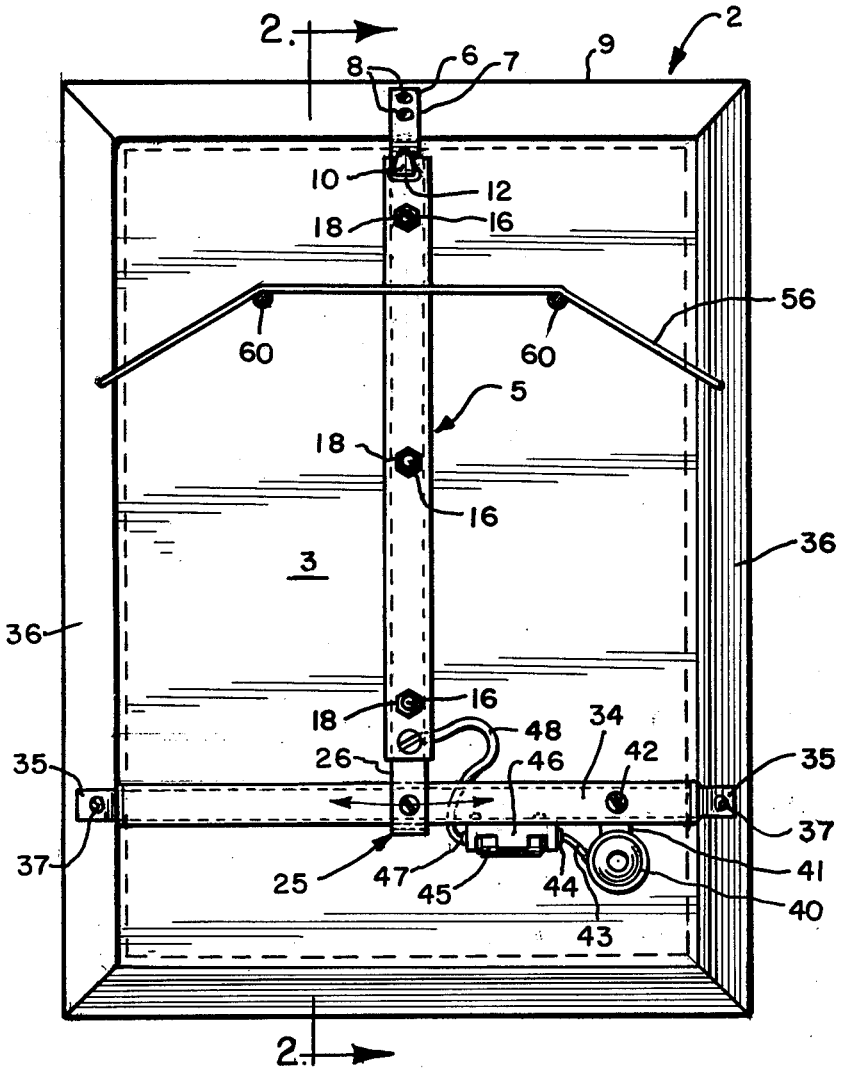
FIG. 1 is a rear elevational view of a painting with the invention applied thereto.
Figure 2:
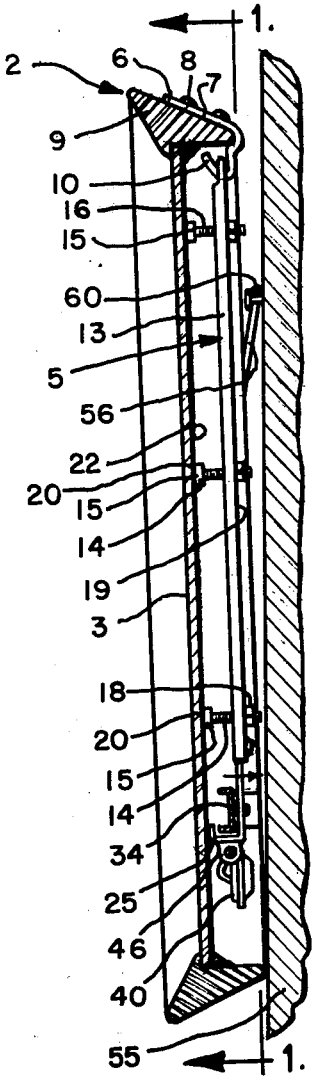
FIG. 2 is a cross-sectional view taken substantially on line 2—2 of FIG. 1.
Figure 3:
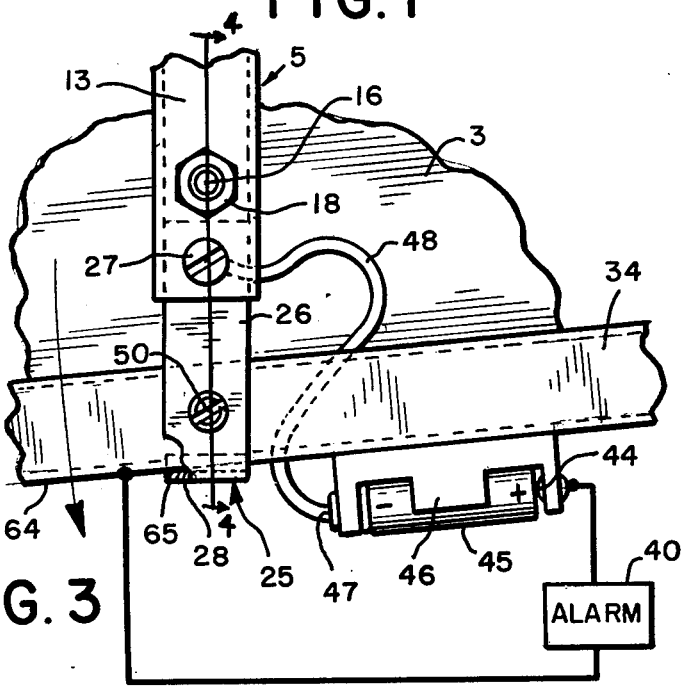
FIG. 3 is an enlarged rear view showing the painting and switch in a lateral or side tilted closed position.
Figure 4:
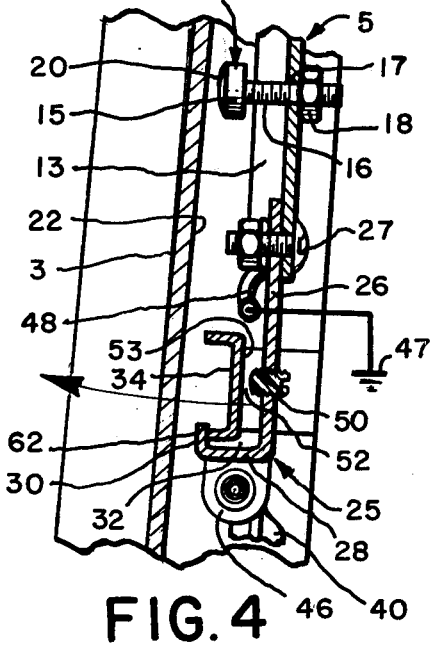
FIG. 4 is an enlarged cross-sectional view taken substantially on line 4—4 of FIG. 3 showing the parts in rear tilted position.

The preferred embodiment of the invention is disclosed in the drawings. There is shown a frame 2 in which is mounted the art work canvass 3 which is flexible transversely of the frame.

The anti-theft device generally indicated 5, comprises a hook member 6 having a shank 7 secured as by screws 8,8 to the top frame member 9. The lower hook end 10 extends through an eye 12 provided in the upper end of a pendular switch bar 13 on which there are mounted a series of vertically spaced contacts 14,14. Each contact comprises a bolt having a flat head 15 and a shank 16 threaded through an opening 17 in the bar 13. A locking nut 18 is threaded onto the free end of the shank 16 and is tightened after the back side 19 of the bar 13 upon the front face 20 of the head 15 being suitably adjusted with respect to the back side 22 of the canvass 3 such that upon a person touching the front side of the canvass for investigating the texture of the paint and the like or defacing the work of art, upon a predetermined amount of movement of the canvass, this movement will be translated from the canvass to the proximate contact 14 and thus to the bar 13.

The bar is provided at its lower end with a hook-shaped contact 25, which has a vertical leg 26 secured by a nut and bolt assembly 27 to the bar. The lower end of the leg 26 is integral with a forwardly extending leg 28 which at its forward end is provided with an upstanding flange 30. The legs 26,28 and flange 30 define an upwardly open horizontal channel 32 through which extends a horizontal metal contact bar 34.

The bar 34 may be of U-shape channel design as shown or flat, if desired. The ends 35, 35 of the bar 34 overlap the side members 36,36 of the frame and are secured thereto as by screws 37,37.

A conventional electrical buzzer or horn or other sound emitting device 40 has one of its electrical terminals 41, which also serves as a mounting, connected by a nut and bolt assembly 42 to the bar 34 at one side of the vertical bar 13 and has its other terminal in the nature of a wire lead 43 connected to one pole 44 of a battery 45 which is carried in a holder 46 suitably secured as by screws (not shown) to the bottom side of the horizontal contact bar 34. The other pole 47 of the battery is connected by a flexible wire 48 to the metal contact 25 by the bolt assembly 27.

The contact member 25 also has an adjustable contact element 50 threaded through the vertical leg to vary the fore and aft spacing 52 with respect to the back side of the bar 34. This spacing will be somewhat determined by the positioning of the art piece on the wall 55 as it is hung by the wire 56 connected to the frame members 36,36 at opposite ends 57,57 and from the hooks 60,60 which are set in the wall 55.

Thus it will be readily apparent that if the painting is touched, the vertical switch bar will swing about the upper universal joint defined by the eye and hook 10,12 rearwardlay bringing the flange 30 of the contact 25 at the lower end of the bar 13 into electrical contact with the front edge 62 of the horizontal bar 32 completing the circuit through the alarm and battery and the wire 48 so that the current flow from the battery will excite the alarm. If the painting is tilted sidewise, the pendulum bar tilts sidewise contacting an edge 64 of the horizontal leg 28 with the bottom side of the horizontal bar 34 at 65 thus also completing the circuit a heretofore described. If the painting is tilted such that its upper end moves away from the wall then contact member 25 would via member 50 contact the back side 53 of member 34 and close the circuit. Thus no manner how the painting is moved, the alarm will sound and alert the guards. It will also be noted that the alarm system is adjustable to change its sensitivity to movements.

It will be apparent that the instant invention can be used is a closed circuit system whereat the bars 13 and 34 are in contact and the alarm bell is connected through a circuit which upon the bars 13 and 34 being moved out of contact, the alarm circuit is actuated. The essence of the arrangement is in the simplicity of the invention and the positioning of the contact bars such that upon the art piece being moved, the alarm will actuate.

Having described a preferred embodiment of the invention, various modification will now become apparent from the specification and the drawings which fall within the scope of the appended claims.

I claim:

1. An anti-theft device for mounting on the backside of a painting canvas or the like comprising a pair of intersectingly arranged contact elements disposed, in the mounted position of the painting, in selectively open (non-contacting) or closed (contacting) positions with respect to each other, means including an alarm and a circuit connected through said contact elements for setting off the alarm, means movably mounting at least one of said contact elements with respect to the other for movement from open to closed position to actuate the alarm circuit upon movement of said painting, and means for inhibiting touching of the canvas comprising movement translating means disposed on said one of said contact elements in opposition to the backside of the canvas for movement thereby into circuit alarm operating position upon predetermined deflection of the canvas.

2. The invention according to claim 1, one of said contact elements being vertically oriented and having means spaced from its upper end for establishing electrical contact (in said closed position) or out-of-contact (in said open position) to the other element.

3. The invention according to claim 2, the other of said elements being stationary and extending transversely of said one element.

4. The invention according to claim 1, said movement translating means comprising, on said one of said contact elements, at least one extensible member adjustable toward and away from the back side of the painting canvas for sensing said deflection of said canvas.

5. An anti-theft device for mounting on the back side of a painting canvas or the like comprising a pair of intersectingly arranged contact elements disposed, in the mounted position of the painting, in selectively open (non-contacting) or closed (contacting) positions with respect to each other, means including an alarm and a circuit connected through said contact elements for setting off the alarm, and means movably mounting at least said one of said contact elements with respect to the other for movement from open to closed position to actuate the alarm circuit upon movement of said painting, one of said contact elements having at least one contact member adjustable toward and away from the back side of the painting canvas, said one contact element being perpendicularly movably mounted, and said one contact member comprising a screw having a shank threaded into said one contact element and having a head opposing the canvas, and said one element having a lower hook portion defining an upwardly open channel and the other element extending generally horizontally through said channel.

6. The invention according to claim 5 and adjustable means between said hook portion and said other element for limiting the movements therebetween.

7. An anti-theft device for mounting on the backside of a painting canvas or the like comprising a pair of intersectingly arranged contact elements disposed, in the mounted position of the painting, in selectively open (non-contacting) or closed (contacting) positions with respect to each other, means including an alarm and a circuit connected through said contact elements for setting off the alarm, means movably mounting at least one of said contact elements with respect to the other for movement from open to closed position to actuate the alarm circuit upon movement of the painting, each element being made of electrically conductive material, one element being hung vertically and the other extending horizontally, means for supporting said one element at its upper end for universal movement, a hook shaped portion on the lower end of said one element having a vertical leg extending at one side of the other element, a lower leg extending beneath said other element and having an upwardly extending portion at the other side of said other element, said one element being swingable sidewise and fore and aft to electrically engage said lower hook portion with said other element, a battery having a pole connected to said one element, said alarm having a first terminal connected to the other pole of the battery, and having a second terminal connected to the other element.

8. The invention according to claim 7, said one element having a series of movement transfer members extending therefrom toward said painting.

9. The invention according to claim 8, an electric contact member adjustably mounted on said vertical leg for varying the spacing with respect to the other element for electrical contact therewith attendant to predetermined movements of the painting.

* * * * *